US006361078B1

(12) United States Patent
Chess

(10) Patent No.: US 6,361,078 B1
(45) Date of Patent: Mar. 26, 2002

(54) MULTI-PLY INTEGRATED LABEL FORM

(75) Inventor: Stanley C. Chess, Goffstown, NH (US)

(73) Assignee: Moore U.S.A. Inc., Grand Island, NY (US)

( * ) Notice: Subject to any disclaimer, the term of this patent is extended or adjusted under 35 U.S.C. 154(b) by 135 days.

(21) Appl. No.: 09/079,537

(22) Filed: May 15, 1998

(51) Int. Cl.[7] ..... B42D 15/00

(52) U.S. Cl. ..... 283/81; 229/92.8; 281/2; 283/904; 462/8; 462/64

(58) Field of Search ..... 462/6, 7, 8, 11–13, 462/31–35, 37–42, 64–65; 281/2, 5; 283/81, 904; 229/70, 71, 92.1, 92.3, 92.8

(56) References Cited

U.S. PATENT DOCUMENTS

| | | | | | |
|---|---|---|---|---|---|
| 3,914,483 | A | | 10/1975 | Stipek, Jr. | 428/42 |
| 4,584,219 | A | | 4/1986 | Baartmans | 428/42 |
| 4,706,877 | A | * | 11/1987 | Jenkins | 229/73 |
| 4,809,906 | A | * | 3/1989 | Lombardo | 229/73 |
| 4,919,325 | A | * | 4/1990 | Culver | 229/71 |
| 4,983,438 | A | | 1/1991 | Jameson | 428/42 |
| 4,995,642 | A | * | 2/1991 | Juszak et al. | 283/105 |
| 5,062,570 | A | * | 11/1991 | Ashby | 229/71 |
| 5,076,489 | A | * | 12/1991 | Steidinger | 229/71 |
| 5,259,906 | A | | 11/1993 | Poplawski et al. | 156/252 |
| 5,267,898 | A | * | 12/1993 | Doll et al. | 462/6 |
| 5,279,875 | A | * | 1/1994 | Juszak et al. | 428/42 |
| 5,288,014 | A | * | 2/1994 | Meyers et al. | 229/304 |
| 5,316,208 | A | * | 5/1994 | Petkovsek | 229/71 |
| 5,370,302 | A | * | 12/1994 | Dyer | 229/92.8 |
| 5,381,947 | A | * | 1/1995 | Steidinger | 229/71 |
| 5,383,686 | A | | 1/1995 | Laurash | 283/81 |
| 5,419,591 | A | * | 5/1995 | Lambert et al. | 283/79 |
| 5,486,021 | A | | 1/1996 | Laurash | 283/81 |
| 5,495,981 | A | * | 3/1996 | Warther | 229/71 |
| 5,509,694 | A | | 4/1996 | Laurash et al. | 283/81 |
| 5,547,227 | A | | 8/1996 | Laurash et al. | 283/81 |
| 5,586,788 | A | | 12/1996 | Laurash | 283/81 |
| 5,601,313 | A | * | 2/1997 | Konkol et al. | 283/81 |
| 5,633,071 | A | | 5/1997 | Murphy | 428/195 |
| 5,704,650 | A | | 1/1998 | Laurash et al. | 283/81 |
| 5,705,243 | A | * | 1/1998 | Mehta et al. | 428/40.1 |

* cited by examiner

*Primary Examiner*—A. L. Wellington
*Assistant Examiner*—Monica Carter
(74) *Attorney, Agent, or Firm*—Simpson, Simpson & Snyder, PLLC

(57) ABSTRACT

The invention broadly comprises a multi-ply integrated label form including a first ply having an upper side and an underside and having a first die cut window and a second die cut window, and also having an integral marginal feed strip along a first edge of the first ply and a detachably secured marginal feed strip along a second edge of the first ply, where the first edge and second edge are parallel to one another; a second ply having a label portion, a card stock portion adjacent to and detachably secured to the label portion, a marginal strip portion adjacent to and detachably secured to the card stock portion, and a marginal feed strip portion adjacent to and detachably secured to the marginal strip portion, each of the label portion, card stock portion, marginal strip portion, and marginal feed strip portion having an upper side and an underside, the underside of the label portion and of the marginal strip portion being coated with an adhesive, wherein the first ply is removably secured to the second ply; and, a third ply comprising a first portion and a second portion, each of the third ply first and second portions having an upper side coated with a release material, the third ply first portion being in register with the second ply label portion and removably secured thereto by the adhesive, and the third ply second portion being in register with the second ply marginal strip portion and removably secured thereto by the adhesive.

7 Claims, 7 Drawing Sheets

MULTI-PLY INTEGRATED LABEL FORM

FIELD OF THE INVENTION

This invention relates generally to business forms and, more particularly, to multi-ply integrated label forms which expedite and simplify inventory control, shipment, tracking and return of packages.

BACKGROUND OF THE INVENTION

The simplest of shipping labels include two components: a place for the designation of addressor and addressee. With the advent of computers and other electronic equipment, sophisticated automated systems have evolved to track packages from warehouse inventory to addressee. In addition to computers, these systems may include high-speed printers, bar code readers, optical character recognition software and the like. While these advanced systems have proven efficient in the tracking and initial shipment of products, it is only possible to take full advantage of technology if the consumer who receives the package has an easy and efficient way to return the product if necessary. Ideally, the label used to ship the product should also be capable of use for the return. The label should include not only addressee ("To:") and addressor ("From:") information but also warehouse and SKU information. It is desirable that the label contains a separate mail piece, which can be used to alert the sender of the return. Most importantly, the label should be easy to use.

Others have invented multi-ply label forms for other purposes. For example, U.S. Pat. No. 5,547,227 (Laurash et al.) discloses a laminated label form with removable portions. This label is intended for use in business operations such as materials handling, inventory control, package shipping, prescribing medications and other medical treatments. While this invention solves some problems associated with automated shipping systems, it does not address the need for a simplified means of shipping and tracking return packages.

U.S. Pat. No. 4,983,438 (Jameson) also discloses a multi-ply form with attached labels and multiple form parts. This invention is intended for use in tracking products in wholesaling, distribution and retailing. It also includes provision for a bill of lading form. Again, the invention teaches no use or solution to the problem of shipping and tracking return packages.

Clearly what is needed then is a multi-ply integrated label form which is easy to use and facilitates shipment, return, inventory control and product tracking.

SUMMARY OF THE INVENTION

The invention broadly comprises a multi-ply integrated label from including a first ply having an upper side and an underside and having a first die cut window and a second die cut window, and also having an integral marginal feed strip along a first edge of the first ply and a detachably secured marginal feed strip along a second edge of the first ply, where the first edge and second edge are parallel to one another; a second ply having a label portion, a card stock portion adjacent to and detachably secured to the label portion, a marginal strip portion adjacent to and detachably secured to the card stock portion, and a marginal feed strip portion adjacent to and detachably secured to the marginal strip portion, each of the label portion, card stock portion, marginal strip portion, and marginal feed strip portion having an upper side and an underside, the underside of the label portion and of the marginal strip portion being coated with an adhesive, wherein the first ply is detachably secured to the second ply; and, a third ply comprising a first portion and a second portion, each of the third ply first and second portions having an upper side coated with a release material, the third ply first portion being in register with the second ply label portion and secured thereto by the adhesive, and the third ply second portion being in register with the second ply marginal strip portion and secured thereto by the adhesive.

A general objective of the invention is to provide a business form which expedites and simplifies inventory control, shipment, tracking and return of packages.

Another object of the invention is to provide a label form which contains a removable card which can be used by the recipient to alert the sender that the package is about to be returned.

Finally, an object of the invention is to provide a multi-ply integrated label form as described above which is easy to use.

These and other objects, features and advantages of the invention will become readily apparent to those having ordinary skill in the art upon a reading of this specification and appended claims as illustrated by the drawings.

DETAILED DESCRIPTION OF THE PREFERRED EMBODIMENT

Figure 1:
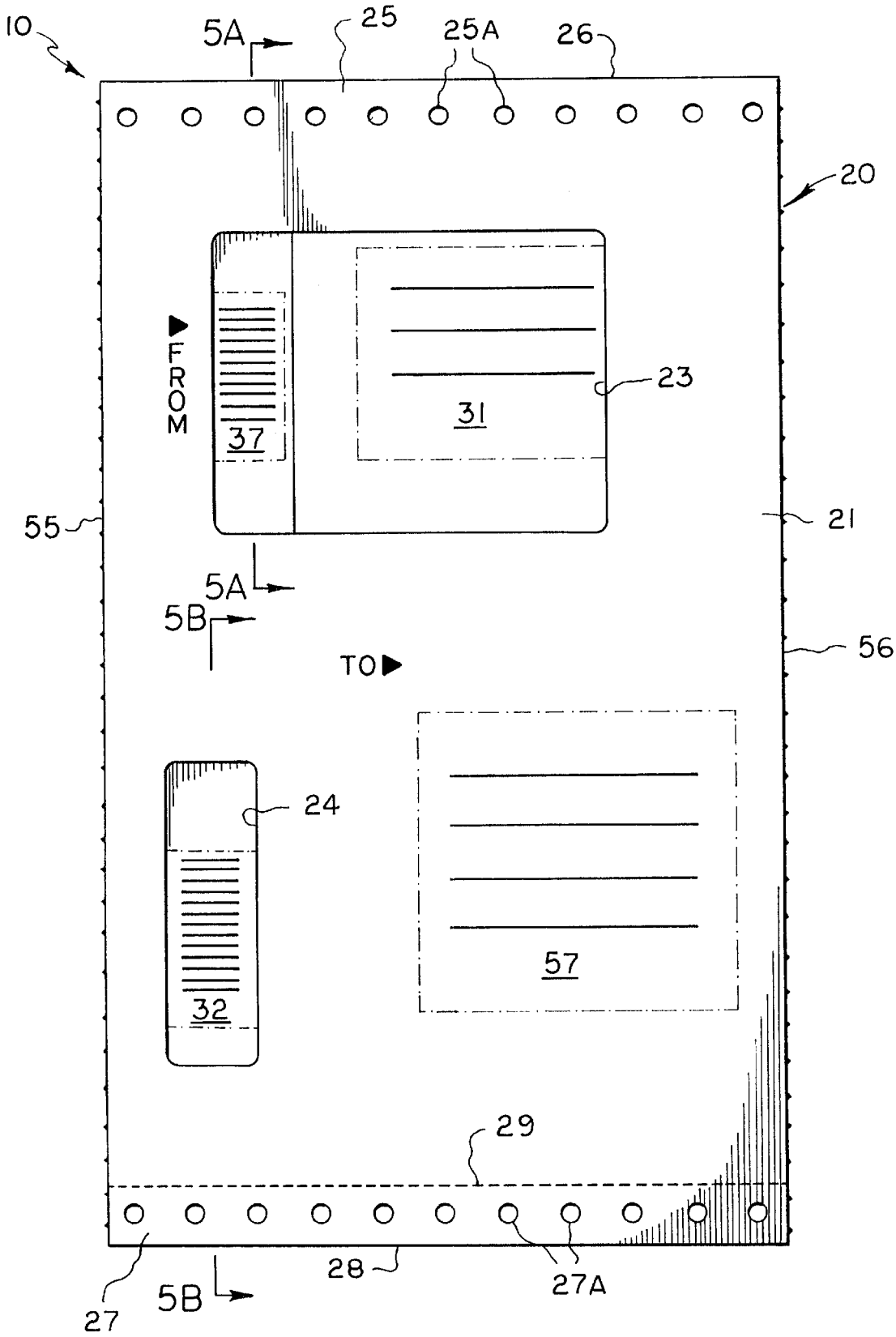
FIG. 1 is a plan view of the multi-ply integrated label form of the invention.

At the outset it should be understood that identical reference numbers on different drawings refer to identical structural elements. In addition, underscored reference numbers (e.g., 57) refer to general areas on the individual plies of the form. The boundaries of these general areas are represented by dotted lines, and it is to be understood that these dotted lines define the area generally and are not intended to represent either perforations or printed indicia on the individual plies. These general areas are intended to contain or receive printed indicia. Moreover, although the present invention is described herein with reference to a specific preferred embodiment, it will be readily apparent to those skilled in this art that various modifications and improvements can be made without departing from the spirit and scope of the invention as claimed. Finally, in the description that follows, the term "sender" identifies the entity that first sends a package to another. The term "recipient" identifies the entity that first receives a package from the sender. The sender and recipient are fixed entities in the following description. Alternatively, the terms "addressor" and "addressee", which also identify the sender and recipient, are dynamic and depend upon the operational use of the form. For example, in an initial shipment, the sender and the addressor are the same, as are the recipient and the addressee. Should the recipient return a package, however, the recipient becomes the addressor, and the sender becomes the addressee.

The multi-ply integrated label form of the present invention can be used in a variety of different business operations, including inventory control, shipping, tracking and the like. However, the present invention is especially well-suited for use in providing an easy and efficient way for the recipient of a package to return a package to the sender, using the label form as a return address form, and also to detach a postcard from the form to separately notify the sender of the impending return. In addition, a bar code on the returned postcard can be matched with a bar code on the return label (attached to the package) to facilitate tracking and inventory control. Accordingly, these aspects of the invention are described in detail.

The integrated form of the invention uses die cut windows and removable label portions in the various plies to obtain maximum use of each component of the label form. For example, the sender's address is initially printed onto the upper side of the second or intermediate ply through a first die cut window in the first or upper ply. With the first ply intact, the sender's address indicates the address of the addressor but, once the first ply has been removed, the sender's address becomes the address of the intended addressee. Similarly, a bar code or other indicia may be printed on the card stock portion of the second ply through a second die cut window in the first ply.

In the description which follows, the terms "removably secured" and "detachably secured" are intended to mean that one portion of the integrated form is initially secured to another portion (by perforations, paste, or pressure sensitive adhesive, for example) and that these two portions may be separated from one another without damaging either portion. The removable and detachable portions are secured to the various label parts in a variety of ways. In the second ply, for example, the card portion is detachably secured to adjacent portions with perforations. The label portion of the second ply includes a smaller die cut label portion, which may be detached therefrom. Both label portions of the second ply include an adhesive backing which secures the portion to the release portions of the third ply. The adhesive may be any suitable releasable adhesive. Most commonly, the adhesive is a pressure sensitive adhesive.

The terms "register", "in register" and "being in register" are all intended to mean that a portion of the form in one ply is located directly underneath (or above) a portion of the form in another ply. These terms do not necessarily imply or mean that the two form portions in question are of identical dimensions and exactly overlap one another, although form portions that do so are within the definition.

Adverting now to the drawings, FIG. 1 is a plan view of multi-ply integrated label form 10. In a preferred embodiment, the label form comprises three plies 20, 30 and 50, as shown in exploded perspective view in FIG. 4. FIG. 1 illustrates first ply 20, which is also the top ply. First ply 20 typically comprises paper stock of any suitable weight, although it could be made of another suitable material as well. Typically, the label form is one of a plurality of identical forms in a web or roll of forms. The individual forms are separable from one another at third edge 55 and fourth edge 56. These edges are typically perforated or partially die-cut to facilitate separation of one form from an adjacent form in the web.

In a preferred embodiment, the web of forms is designed to be tractor fed to a suitable printer. To this end, first ply 20 includes integral marginal feed strip 25 along first edge 26, and detachably secured marginal feed strip 27 along second edge 28. The marginal feed strips comprise a plurality of co-linear holes 25A and 27A, respectively, parallel to the edges of the form, suitable for engagement with a printer tractor feed. Detachably secured marginal feed strip 27 is perforated in the first ply along line 29. This enables the first ply to be detached from the form to reveal the underlying second ply. It should be noted that, although the preferred embodiment of the present invention comprises a form which is part of a web of forms, and also includes marginal tractor feed strips, these elements of the preferred embodiment are not essential to the invention, and therefore are not intended to limit the scope of the claims of the invention. The multi-ply integrated form label could, for example, be made as a single form, suitable for sheet feeding in a printer, without tractor feed capability.

With reference to FIG. 1, it is seen that first ply 20 has an upper side 21. Side 21 includes area 57 where a user may print the initial addressee ("TO") information, for example. First ply 20 also comprises first die cut window 23 and second die cut window 24. These die cut windows expose portions of the second, or intermediate ply 30. For example, areas 31, 32 and 37 of second ply 30 are clearly visible through these die cut windows. In a preferred embodiment, when a package is first shipped from the sender, the addressor ("FROM") information could be printed in area 31 of second ply 30 through die-cut window 23, (although the printed indicia "FROM" is printed on first ply 20). Thus, the addressor information is visible even with the first ply still attached to the second ply. Other information can similarly be printed in areas 32 (through die cut window 24) and 37 (through die cut window 23) of second ply 30. For example, a product bar code can be printed in area 32, and warehouse-tracking information can be printed in area 37.

Figure 2:
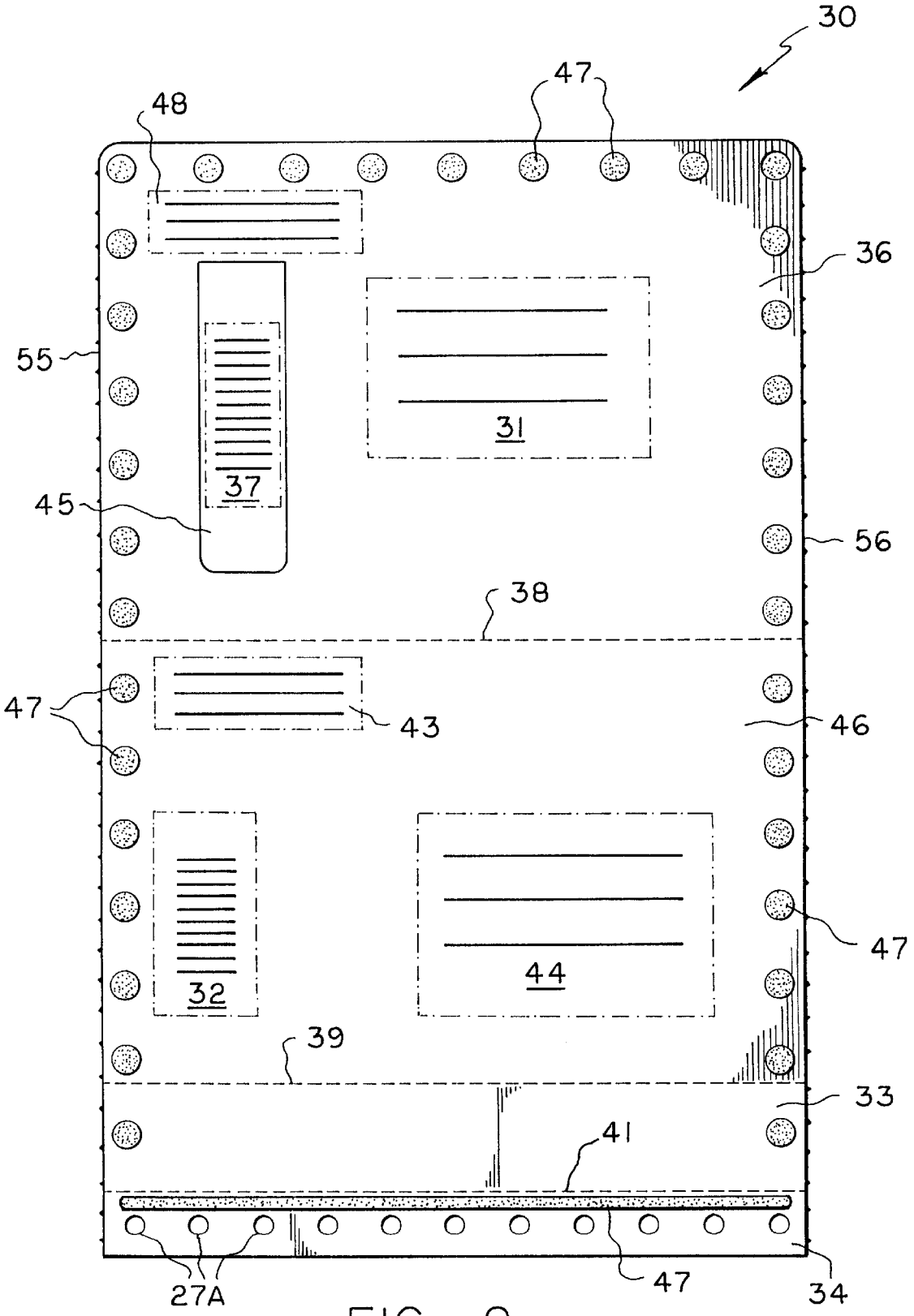
FIG. 2 is a plan view of the second ply of the multi-ply integrated label form of the invention.

FIG. 2 illustrates second ply 30 in top plan view. Again, separation of first ply 20 along perforation 29 reveals second ply 30. Second ply 30 generally comprises label portion 36; card stock portion 46, second ply marginal strip portion 33, and second ply marginal feed strip portion 34. In a preferred embodiment, the second ply is spot pasted at plurality of locations 47 to the underside of the first ply.

Label portion 36 is comprised of any suitable label material, and has its underside coated with an adhesive, preferably a pressure sensitive adhesive. The adhesive secures the label portion to a release ply (third ply of form) to be described infra. The general purpose of label portion 36 is to function as an address label for return of the package. To this end, the addressor information for the sender that was previously printed in general area 31 of the label portion, now functions as the addressee information as the package is returned to the sender. The recipient can then print addressor information in general area 48 of the label portion. Label portion 36 also contains die cut label portion 45 that contains area 37. The underside of label portion 36 is also preferably coated with a pressure sensitive adhesive. As mentioned earlier, area 37 is suitable for receiving printed indicia such as warehouse tracking information. This information can be matched with corresponding information on the return postcard (to be described infra) to track packages upon return.

Postcard 46 of second ply 30 is detachably secured to label portion 36 and to third ply portion 51A (shown in FIG. 3) at perforation 38, and is detachably secured to marginal strip portion 33 and third ply portion 51B (shown in FIG. 3) at perforation 39. The postcard is comprised of any suitable card stock. It should be noted that, although the postcard is detachably secured within the second ply by perforations in a preferred embodiment, it could be detachably secured by other suitable means.

The function of postcard 46, in a preferred embodiment, is to separately notify the sender that the package is being returned. (It could, alternatively, be used to register a product.) To this end, the card contains general area 44 for addressee information, and general area 43 for addressor information. These areas may be pre-printed with appropriate indicia, or may be completed by the recipient. In a preferred embodiment, marginal strip portion 33 is also a label secured by pressure sensitive adhesive to a release portion of the third ply. As described previously, marginal strip portion 33 is detachably secured to postcard 46 at perforation 39; it is also detachably secured to second ply marginal feed strip portion 34 at perforation 41. It should be appreciated that it is not essential that marginal strip portion 33 is in the form of an adhesive label, or that this label portion be detachably secured to the marginal feed strip portion. What is important is that the postcard is detachably secured, and easily removable, from the second ply.

Figure 3:
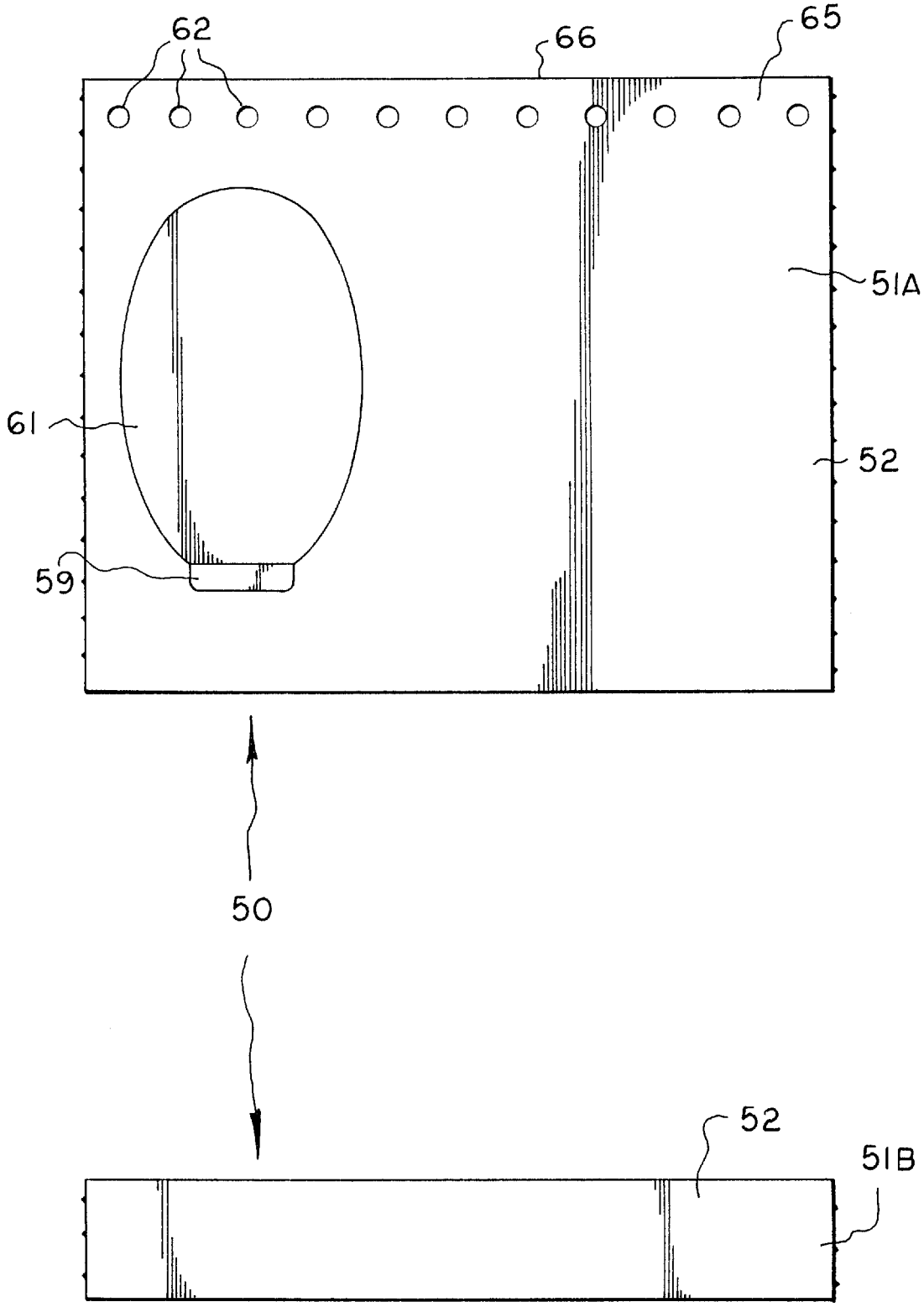
FIG. 3 is a plan view of the third ply of the multi-ply integrated label form of the invention.

Third ply 50 is illustrated in plan view in FIG. 3. This ply comprises two release liner plies 51A and 51B. Each of these portions is coated on its upper side 52 with a silicone polymer or other suitable release material to permit easy release of the release liner ply portions from the pressure sensitive adhesive on the underside of portions of the second ply, described infra. Portion 51A is in registration with label portion 36 shown in FIG. 2. Portion 51B is in registration with second ply marginal strip portion 33. Portion 51A contains marginal strip 65 bordered by edge 66. Strip 65 contains a plurality of co-linear holes 62, which holes are aligned with holes 25A of the first ply, and are used to tractor feed the integrated label form through a printer. Release liner portion 51A also contains die cut portion 61 and die cut window 59. A portion of release liner portion 51A removed to form window 59 remains adhered to label portion, 45 to create a tab to facilitate easy removal of label portion 45 of the second ply.

Figure 4:
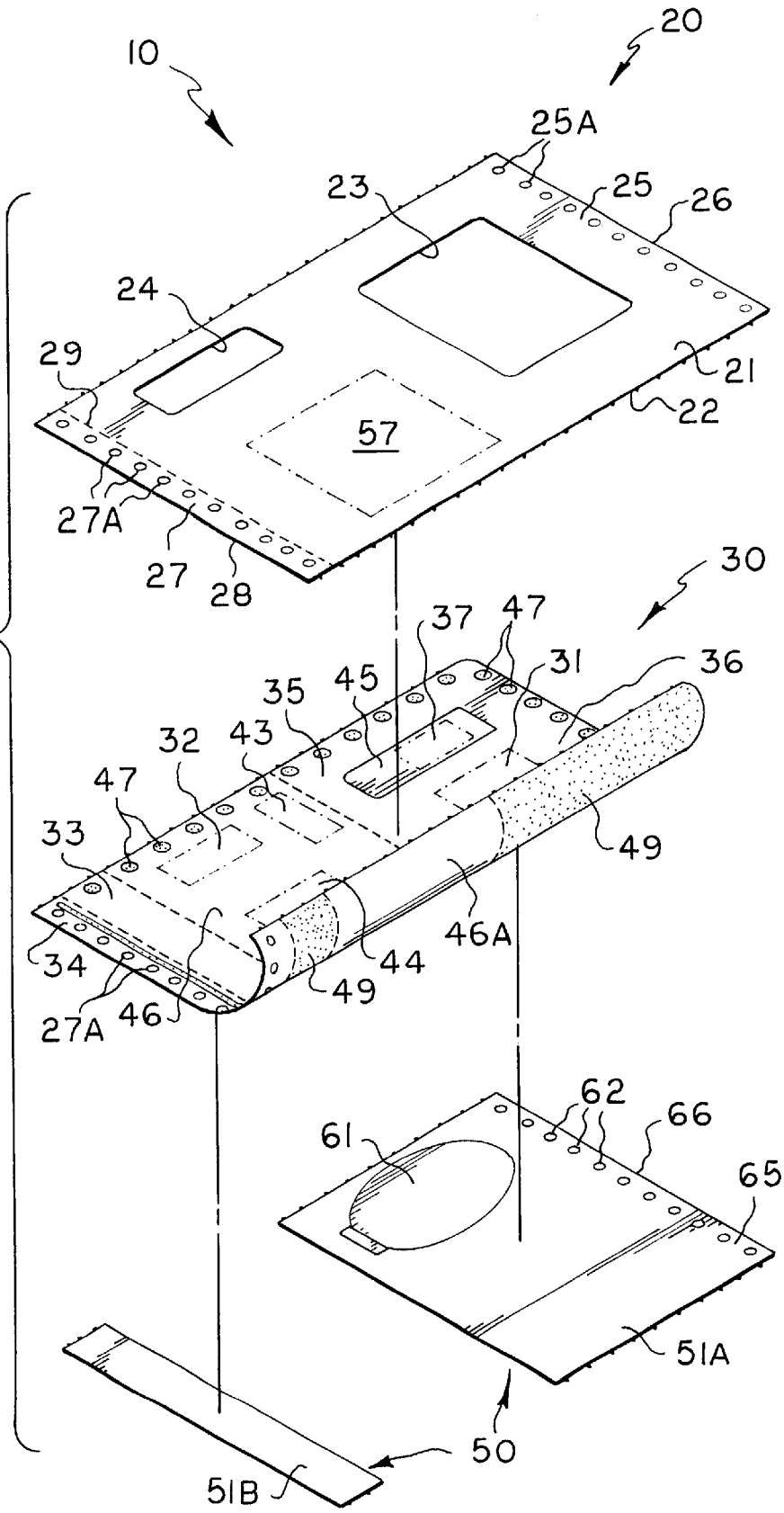
FIG. 4 is an exploded perspective view of the multi-ply integrated label form of the invention.

Multi-ply integrated label form 10 is shown in perspective exploded view in FIG. 4. Second ply 20 is shown curled at one edge to reveal adhesive 49 under the label portions of the ply, and also to reveal the underside 46A of postcard 46. The underside of the card, in the preferred embodiment shown, would contain printed indicia to indicate the reason the product is being returned and how it is being shipped, for example. Obviously, other printed indicia could be included as well.

Figure 5A:
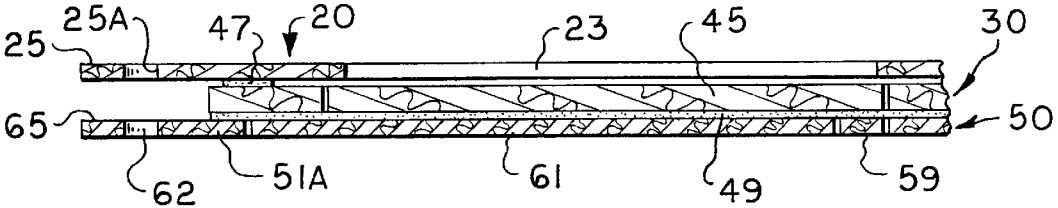
FIG. 5A is an enlarged, fragmentary cross-sectional view of the integrated label form taken generally along line 5A—5A in FIG. 1.
Figure 5B:
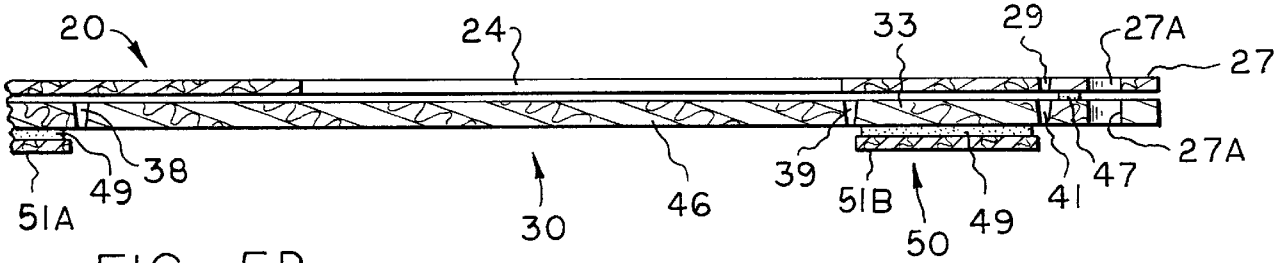
FIG. 5B is an enlarged, fragmentary cross-sectional view of the integrated label form taken generally along line 5B—5B in FIG. 1.

FIG. 5A is a fragmentary cross-sectional view of the integrated label form taken generally along line 5A—5A in FIG. 1. This view clearly shows first ply 20 atop second ply 30 atop third ply 50. First ply 20 is shown spot pasted to second ply 30 at location 47. In contrast, adhesive 49 secures second ply 30 to third ply 50. Adhesive 49 is fixedly secured to the underside of second ply 30. The adhesive is in contact with upper surface 52 of third ply 50 (shown in FIGS. 3 and 6) which is coated with a silicone polymer for easy release of the adhesive from surface 52. FIG. 5B is an enlarged fragmentary cross-sectional view of the integrated label form taken generally along line 5B—5B in FIG. 1.

Figure 6:
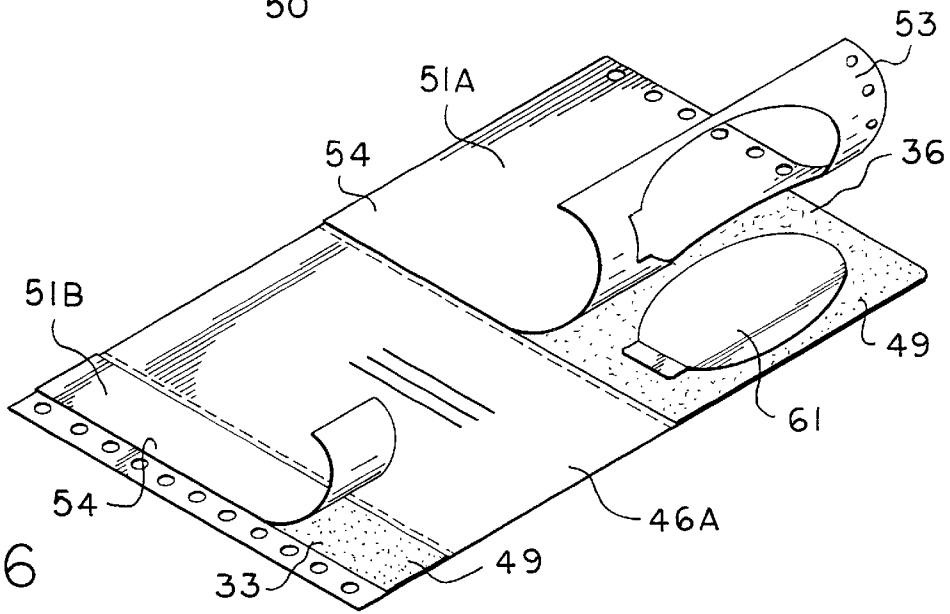
FIG. 6 is a perspective view of the underside of the second ply of the label form, illustrating removal of the release portions of the ply.

The second and third plies are shown in inverted (to show their undersides) perspective view in FIG. 6. In this view, label portion 33 of second ply 30 is shown being removed from portion 51B of third ply 50, revealing adhesive 49. Similarly, label portion 36 of second ply 30 is shown being removed from portion 51A of third ply 50, thereby revealing adhesive 49. Again, surface 52 of third ply portions 51A and 51B is coated with a silicone polymer or other suitable material to permit release from the adhesive.

Figure 7:
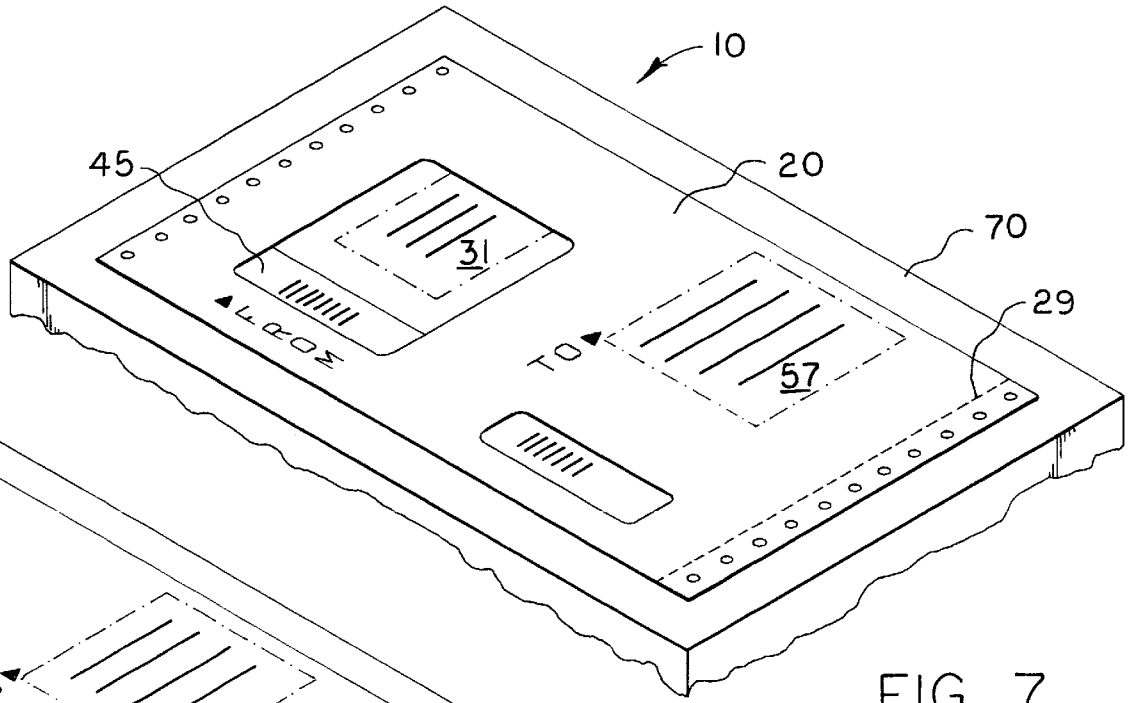
FIG. 7 is a view of the integrated label form in place on a package as it would be sent by the sender and first received by the recipient.
Figure 8:
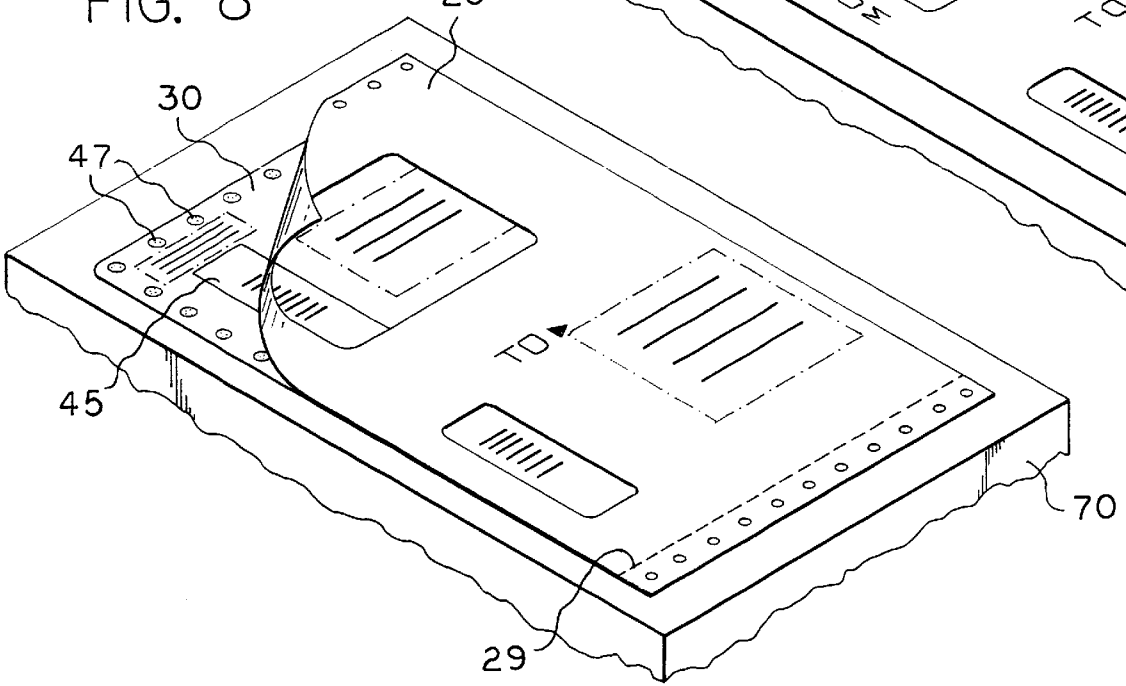
FIG. 8 is a view similar to that of FIG. 7 except illustrating the first ply of the label form being peeled away to prepare the package for a return to the sender.
Figure 9:
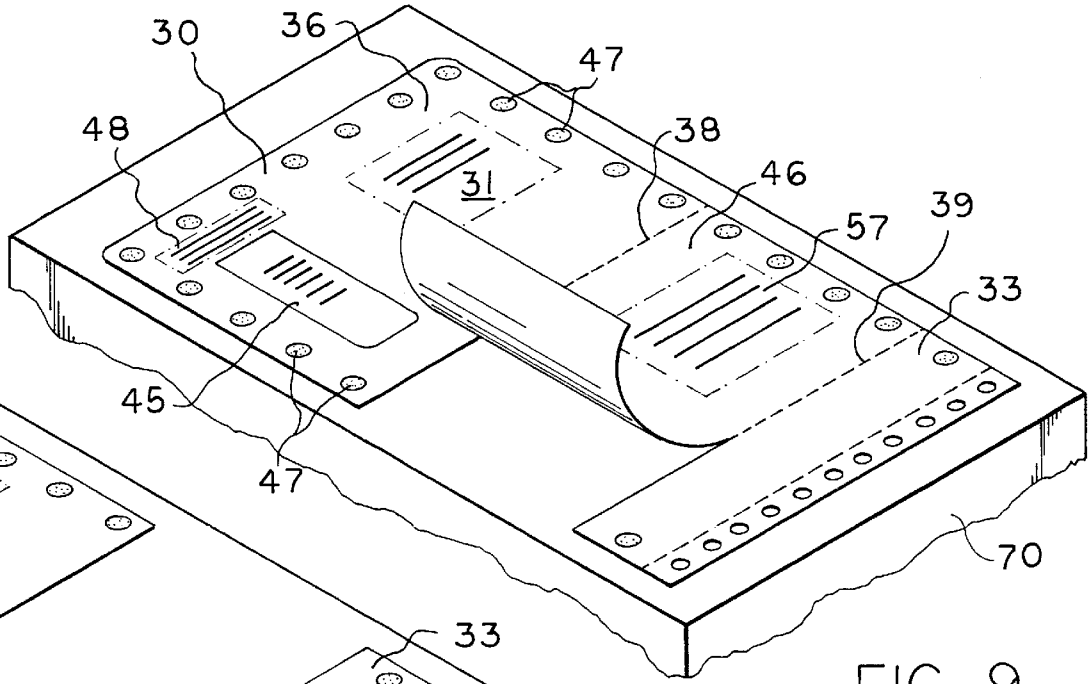
FIG. 9 is a view similar to that of FIG. 8 except illustrating the return postcard of the third (bottom) ply being removed to return to the sender; and, FIG. 10 is a view similar to that of FIG. 9 with the postcard removed, illustrating removal of the die cut portion of the label of the second ply by the sender upon return of the package.
Figure 10:
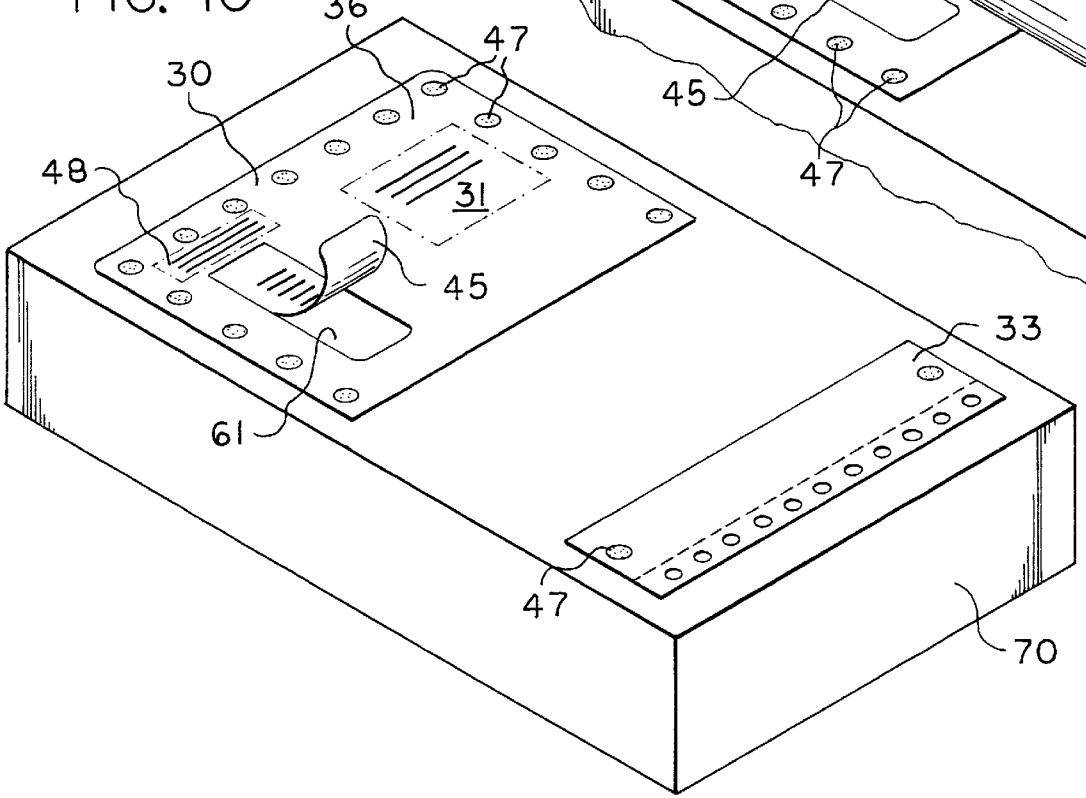

Function of the multi-ply integrated label form of the present invention is best understood with reference to FIGS. 7–10. FIG. 7 illustrates, in fragmentary perspective view, the label 10 of the invention applied to package 70. This view shows the label as it would appear when initially sent by the sender or first received by the recipient. FIG. 8 is a view similar to that of FIG. 7. In this view, the package has been received by the recipient, who is in the process of removing first ply 20 of the label form to reveal second ply 30. In FIG. 9, which is a view similar to that of FIG. 8, the first ply has been completely removed, and the recipient has decided to return the package to the sender, and is in the process of removing postcard 46 from second ply 30. The card will be mailed separately to the sender. Finally, in FIG. 10, which is a view similar to that of FIG. 9, the package has been returned to the sender (with the postcard removed) and the sender is in the process of removing label portion 45 which contains warehouse tracking information in the form of printed indicia.

Thus, it is seen that the objects of the invention are efficiently obtained. The preceding detailed description of the preferred embodiment of the invention is intended to set forth the best mode of the invention known to the inventor, and to describe the invention in sufficient detail to enable one having ordinary skill in the art to make and use the invention. However, the description, attached drawings and claims should not be interpreted as limiting the scope of the claims in any way to the preferred embodiment shown and described. It should be readily apparent to those having ordinary skill in the art that changes in modifications can be made to the invention without departing from the scope and spirit of the appended claims.

What I claim is:

1. A multi-ply integrated label form, comprising:

a first ply having an upper side and an underside and having at least one uncovered die cut window opening therein;

a second ply comprising a label portion and a card stock portion adjacent to and detachably secured to said label portion, each of said label portion and card stock portion having an upper side and an underside, part of said upper side of said label portion accessible and visible through said at least one first ply uncovered die cut window opening, said underside of said label portion being coated with an adhesive, wherein said first ply is removably secured to said second ply; and, a third ply comprising a first portion and a second portion, each of said third ply first and second portions having an upper side coated with a release material, said third ply first portion being in register with said second ply label portion and removably secured thereto by said adhesive, and said third ply second portion being in register with a second ply marginal strip portion and removably secured thereto by said adhesive.

2. A multi-ply integrated label form as recited in claim 1 wherein said first ply further comprises an integral marginal feed strip along a first edge of said first ply and a detachably secured marginal feed strip along a second edge of said first ply, wherein said first edge and said second edge are parallel to one another.

3. A multi-ply integrated label form as recited in claim 1 wherein said second ply further comprises a marginal strip portion adjacent to and detachably secured to said card stock portion, and a marginal feed strip portion adjacent to and detachably secured to said marginal strip portion, and wherein said marginal strip portion and said marginal feed strip portion have an upper side and an underside, said underside of said marginal strip portion being coated with an adhesive.

4. A multi-ply integrated label form as recited in claim 1 wherein said second ply further comprises a removable die-cut portion which is substantially visible and accessible through said uncovered die cut window opening in said first ply.

5. A multi-ply integrated label form as recited in claim 1 wherein at least a portion of said card stock portion of said second ply is visible and accessible through said uncovered die cut window opening in said first ply.

6. A multi-ply integrated label form as recited in claim 2 wherein said integral marginal feed strip of said first ply and said detachably secured marginal feed strip are operatively arranged to engage a printer tractor feed.

7. A multi-ply integrated label form, comprising:

a first ply having an upper side and an underside and having a first uncovered die cut window opening and a second uncovered die cut window opening, and also having an integral marginal feed strip along a first edge of said first ply and a detachably secured marginal feed strip along a second edge of said first ply, where said first edge and said second edge are parallel to one another;

a second ply comprising a label portion, a card stock portion adjacent to and detachably secured to said label portion, a marginal strip portion adjacent to and detachably secured to said card stock portion, and a marginal feed strip portion adjacent to and detachably secured to said marginal strip portion, each of said label portion, card stock portion, marginal strip portion, and marginal feed strip portion having an upper side and an underside, a portion of said upper side of said label portion accessible and visible through said first uncovered die cut window opening, a portion of said card stock portion accessible and visible through said second uncovered die cut window opening, said underside of said label portion and of said marginal strip portion being coated with an adhesive, wherein said first ply is removably secured to said second ply; and, a third ply comprising a first portion and a second portion, each of said third ply first and second portions having an upper side coated with a release material, said third ply first portion being in register with said second ply label portion and secured thereto by said adhesive, and said third ply second portion being in register with said second ply marginal strip portion and secured thereto by adhesive.

* * * * *